US007549908B2

(12) United States Patent
Yudkoff

(10) Patent No.: US 7,549,908 B2
(45) Date of Patent: Jun. 23, 2009

(54) SUPPORT GARMENT

(76) Inventor: Aliza Yudkoff, 200 W. 92nd St., Apt. 2C, New York, NY (US) 10025-7473

( * ) Notice: Subject to any disclaimer, the term of this patent is extended or adjusted under 35 U.S.C. 154(b) by 200 days.

(21) Appl. No.: 11/481,860

(22) Filed: Jul. 5, 2006

(65) Prior Publication Data

US 2007/0010165 A1 Jan. 11, 2007

Related U.S. Application Data

(60) Provisional application No. 60/696,645, filed on Jul. 5, 2005.

(51) Int. Cl.
*A41D 3/00* (2006.01)
*A41D 3/08* (2006.01)

(52) U.S. Cl. ..... 450/62; 450/60; 450/63; 450/33

(58) Field of Classification Search ..... 450/60–62, 450/1, 30, 33, 79, 32, 31
See application file for complete search history.

(56) References Cited

U.S. PATENT DOCUMENTS 1,584,525 A * 5/1926 Freeman ..... 450/62
1,962,314 A * 6/1934 Lytton ..... 450/62
1,972,045 A * 8/1934 Julius ..... 450/62
2,115,398 A * 4/1938 Rosenthal ..... 450/62
2,284,382 A * 5/1942 Elberfeld ..... 450/62
2,487,210 A * 11/1949 Barco ..... 450/62
2,493,179 A 1/1950 Wittenberg
2,664,564 A * 1/1954 Finkelstein ..... 450/62
3,164,155 A * 1/1965 Simonsen ..... 450/62
6,116,985 A 9/2000 Lambert
2002/0022433 A1 2/2002 Yeung et al.

* cited by examiner

*Primary Examiner*—Gloria Hale
(74) *Attorney, Agent, or Firm*—Cozen O'Connor

(57) ABSTRACT

A support garment is disclosed that provides improved support and restraint for a wearer's breasts. The support garment includes a breast support and isolating structure and an outer restraint bandeau that overlies the breast support and isolating structure. In a preferred embodiment, the support garment also includes an upper restraint band that extends horizontally over the wearer's breasts. The wearer's breasts are supported from underneath in a raised position, as well restrained from above. In this manner, the support garment of the present invention isolates the wearer's breasts so as to reduce irritation from chafing and sweating.

16 Claims, 3 Drawing Sheets

FIG. 6
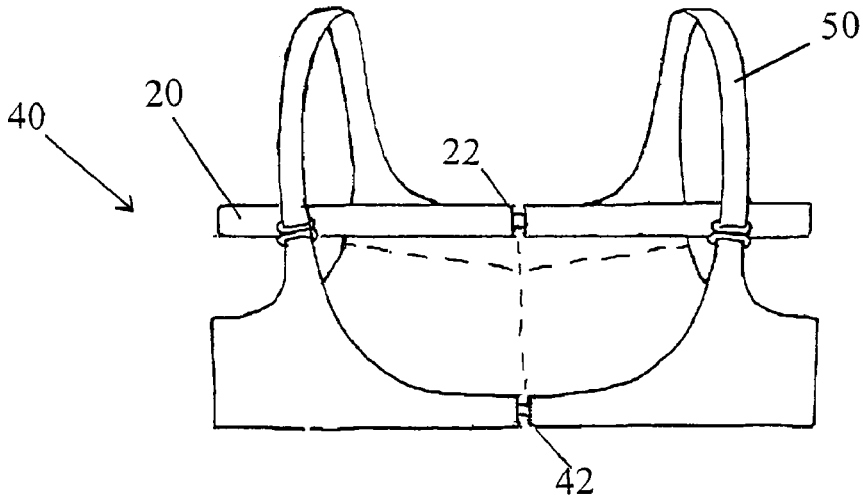
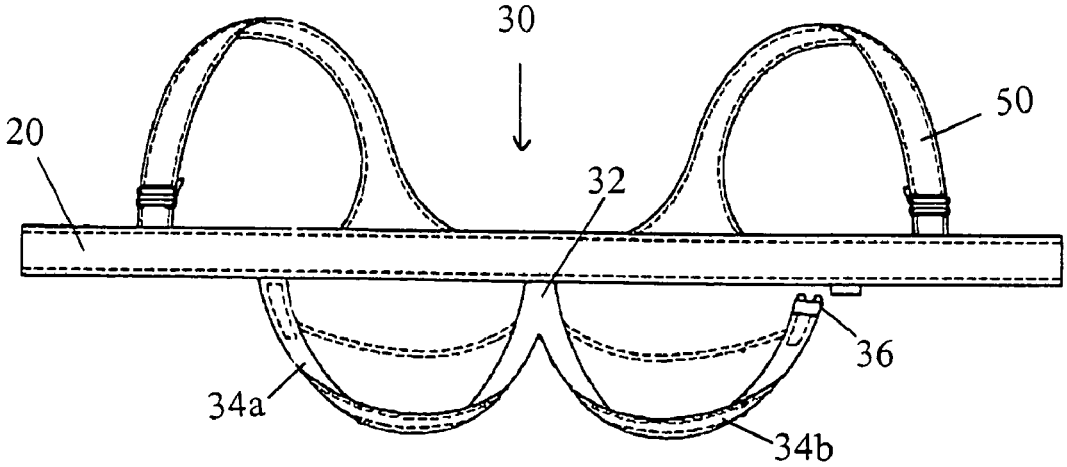
FIG. 4

SUPPORT GARMENT

PRIORITY

This application claims the benefit of U.S. Provisional Application No. 60/696,645, filed Jul. 5, 2005, which is hereby incorporated herein by reference in its entirety.

FIELD OF THE INVENTION

The present invention generally relates to women's apparel, and in particular, to brassieres for women engaged in moderate to intense physical activity and for women with large bust sizes.

BACKGROUND OF THE INVENTION

The brassiere has long been used to alleviate discomfort for women as a result of heaviness and excessive movement of the breasts. Generally, brassieres intended for everyday use provide a cup that supports each breast and distributes the weight of the breast to the shoulders, neck, and back of the woman through straps attached to the cups. Although these brassieres provide some support, they often fail to adequately restrain the breasts. In an effort to increase the support of the traditional bra, an underwire was introduced to the cups to give them more structure and rigidity. Many women find the underwire uncomfortable. Furthermore, the cups of traditional bras are not adjustable and do not allow a woman to customize the fit of the bra based upon her body shape and the intensity of the physical activity in which she will engage. Insufficient breast support and restraint can lead to shoulder, neck, and back pain, as well as stretch marks and sagging of the breasts.

For the physically active woman, sports bras have been used to provide additional support and restraint to alleviate discomfort. Traditionally, sports bras restrain the breasts by distributing the majority of the weight of the breasts to the shoulders. There are a number of deficiencies with the traditional sports bra. Women often experience severe shoulder strain and even pain in the upper back and neck regions from the weight being born by their shoulders. Additionally, breasts restrained by a sports bra are prone to be forced together in the middle of a woman's chest in an aesthetically displeasing formation. The contact between the breasts often results in irritation caused by excessive sweating and chafing. Sports bras are also uncomfortable for women with larger bust sizes. Often times, sports bras slide up and down the body of the wearer during physical activity causing further irritation and chafing, especially to the skin around the ribcage.

Therefore, for the reasons stated above, there is currently a need for a support garment that provides a wearer with total support and restraint of the breasts in a comfortable and fully customizable manner. Furthermore, there is a need for a support garment that restrains and supports the wearer's breasts in a manner that reduces the strain imposed on the wearer's neck and shoulders. There is also a need for a support garment that does not irritate the wearer's breasts or cause chafing. Finally, there is a need for a support garment that supports and restrains the wearer's breasts in a manner that does not allow the breasts to be forced together in the center of the garment.

As described below, the present invention provides a support garment that fulfills these needs.

OBJECTS AND SUMMARY OF THE INVENTION

It is an object of the present invention to provide a new and improved support garment that overcomes the shortcomings of the prior art systems.

It is another object of the present invention to provide a new and improved support garment that provides a wearer with increased support and restraint of the breasts in a comfortable and fully customizable manner.

It is yet another object of the present invention to provide a new and improved support garment that restrains and supports the wearer's breasts in a manner that reduces the strain imposed on the wearer's neck, back, and shoulders.

It is still another object of the present invention to provide a new and improved support garment that prevents irritation and chafing of the wearer's breasts and skin around the ribcage.

It is a further object of the present invention to provide a new and improved support garment that supports and restrains the wearer's breasts in a manner that keeps the breasts separated from each other.

In accordance with the above objectives, the present invention provides a support garment that includes a breast support and isolating structure structured and arranged to extend, when said support garment is worn, between the wearer's breasts, to isolate each breast, and under the wearer's breasts, to provide support. The support garment also includes an outer restraint bandeau structured and arranged to encircle the wearer's body and to overlie the wearer's breasts and the breast support and isolating structure. The breast support and isolating structure is affixed to an inner surface of the bandeau.

BRIEF DESCRIPTION OF THE DRAWINGS

A more complete appreciation of the present invention and many of the attendant advantages thereof will be readily understood by reference to the following detailed description when taken in conjunction with the accompanying drawings, in which:

FIG. 4 is a breast support and isolating structure of the support garment of the present invention;

FIG. 6 is a rear view of an outer restraint bandeau of the support garment of the present invention.

DETAILED DESCRIPTION OF THE INVENTION

Figure 1:
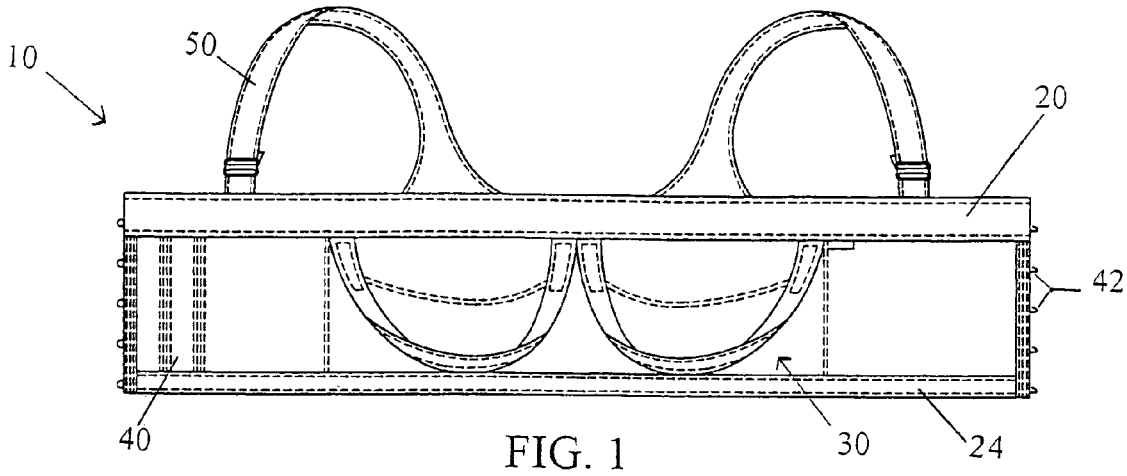
FIG. 1 is a rear view of a new and improved support garment of the present invention.

The invention will now be described with reference to FIGS. 1 to 6, in which FIG. 1 illustrates the support garment 10 of the present invention from a back view. The support garment 10 includes an upper restraint band 20, a breast support and isolating structure 30, and an outer restraint bandeau 40.

Figure 2:
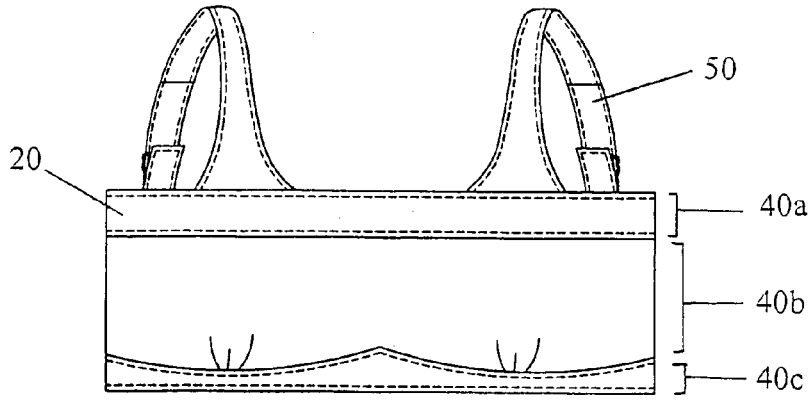
FIG. 2 is a front view of the new and improved support garment of the present invention with two ends of the support garment fastened together.
Figure 3:
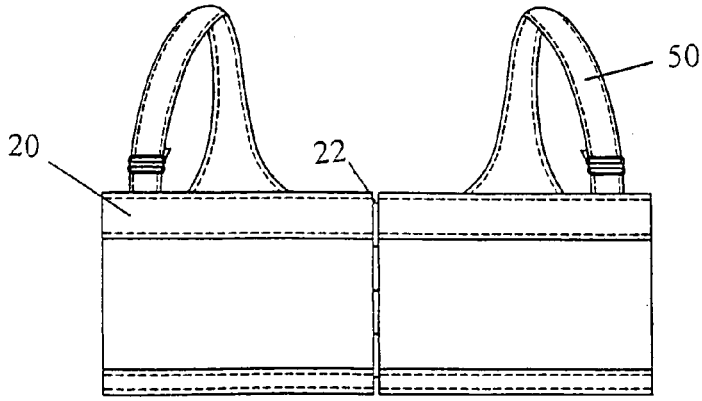
FIG. 3 is a rear view of the first embodiment of a breast support and isolating structure of the support garment of the present invention with two ends of the support garment fastened together.

The upper restraint band 20 is a band of material, preferably with elastic properties, that extends horizontally along the entire length of an upper portion of the support garment 10. Preferably, the upper restraint band 20 forms the upper edge of the support garment 10. As can be seen in FIG. 2, the upper restraint band 20 is arranged such that, when the support garment 10 is worn, the upper restraint band 20 extends horizontally over a top portion of the breasts of the wearer. Both ends of the upper restraint band 20 meet at the wearer's back, as shown in FIG. 3. The ends of the upper restraint band 20 include a means 22 for securing one end to the other, preferably in an adjustable fashion. The fastening means 22 may be any adjustable fastening means known in the art such as hooks, snaps, buckles, Velcro, etc.

Both the breast support and isolating structure 30 and the outer restraint bandeau 40 are secured to the restraint band 20. The upper restraint band 20 may be a separate component of the support garment 10 or it may be part of the breast support and isolating structure 30 or the outer restraint bandeau 40. In any case, the upper restraint band has the same functionality. The upper restraint band 20 limits any upward movement of the breasts. The breasts are compressed downward by the upper restraint band 20 to restrict their movement during physical activity. The upper restraint band 20 also functions to secure the support garment 10 against the body of the wearer in a snug, yet comfortable, manner so that the support garment does not ride up or down the body of the wearer during physical activity.

Referring now to FIG. 4, the breast support and isolating structure 30 is shown by itself. The breast support and isolating structure is a unitary structure that has a breast isolating portion 32 and a pair of breast support strap portions 34(*a, b*).

The breast isolating portion 32 is secured to the upper restraint band 20 at or around the middle of the upper restraint band 20, and extends downward so that it is perpendicular, or at least substantially perpendicular, to the upper restraint band 20. More specifically, the breast isolating portion is structured so that, when the support garment 10 is worn, the breast isolating portion 32 extends vertically between a wearer's breasts. Alternatively, the upper restraint band 20 may be part of the unitary breast support and isolating structure 30. Rather than being secured to the upper restraint band 20, the breast isolating portion 32 may be an extension of the material of the upper restraint band 20 at or around the middle of the upper restraint band 20 which extends in the manner described above. The breast isolating portion 32 separates the breasts from one another so that the breasts are not forced together in the center of the garment in an uncomfortable and aesthetically displeasing manner. Isolating each breast reduces discomfort and irritation associated with contact between the breasts, especially during intense physical activity. In a preferred embodiment, the breast isolating portion 32 ensures that the wearer's breasts are totally isolated from one another.

The breast support strap portions 34(*a, b*) extend from the breast isolating portion 32 toward a respective end of the upper restraint band 20. More specifically, when the support garment 10 is worn, the breast support strap portions 34(*a, b*) extend under each breast, respectively. The ends of the breast support strap portions 34(*a, b*) are secured to opposite sides of the upper restraint band 20. The ends of the breast support strap portions 34(*a, b*) include an adjustable fastening means 36 to secure them to the upper restraint band 20. The fastening means 36 may be any adjustable fastening means known in the art such as hooks, snaps, buckles, Velcro, etc. In a preferred embodiment, the breast support strap portions 34(*a, b*) are made of an elastic material. Examples of the material used for the breast support strap portions are lycra, cotton, nylon, elastic, polyester blend or combinations thereof.

The breast support strap portions 34(*a, b*) support the breasts in a raised position. Supporting the breasts in a raised position reduces the ability of the breasts to move or be jostled during activity, thereby reducing strain on the breasts and on the wearer. The flexible breast support strap portions 34(*a, b*) also provide the structure of a traditional underwire without the drawbacks associated with the stiff underwire.

The adjustable fastening means 36 allow the wearer to customize the fit of the support garment 10 to the wearer's individual breast size. Furthermore, the adjustable fastening means 36 permit the wearer to adjust the fit of the support garment to accommodate the level of physical activity in which the wearer intends to engage. For example, if the wearer intends to engage in very intense physical activity, the wearer can tighten the breast support strap portions 34(*a, b*) to further restrict the breasts from moving. On the other hand, if the wearer will not engage in physical activity, the breast support strap portions 34(*a, b*) may be loosened for increased comfort.

Alternatively, the breast support and isolating structure 30 may include two separate straps rather than being a unitary structure, as shown in FIG. 1. In this embodiment, the breast support and isolating structure is the same as described above, except that each strap functions to both isolate and support the breasts.

The upper restraint band 20 and the breast isolating and support structure 30 function in conjunction with each other to limit the upward and downward movements of the breasts. The result is a decrease in the jostling of the breasts during physical activity which reduces discomfort and strain.

Figure 5:
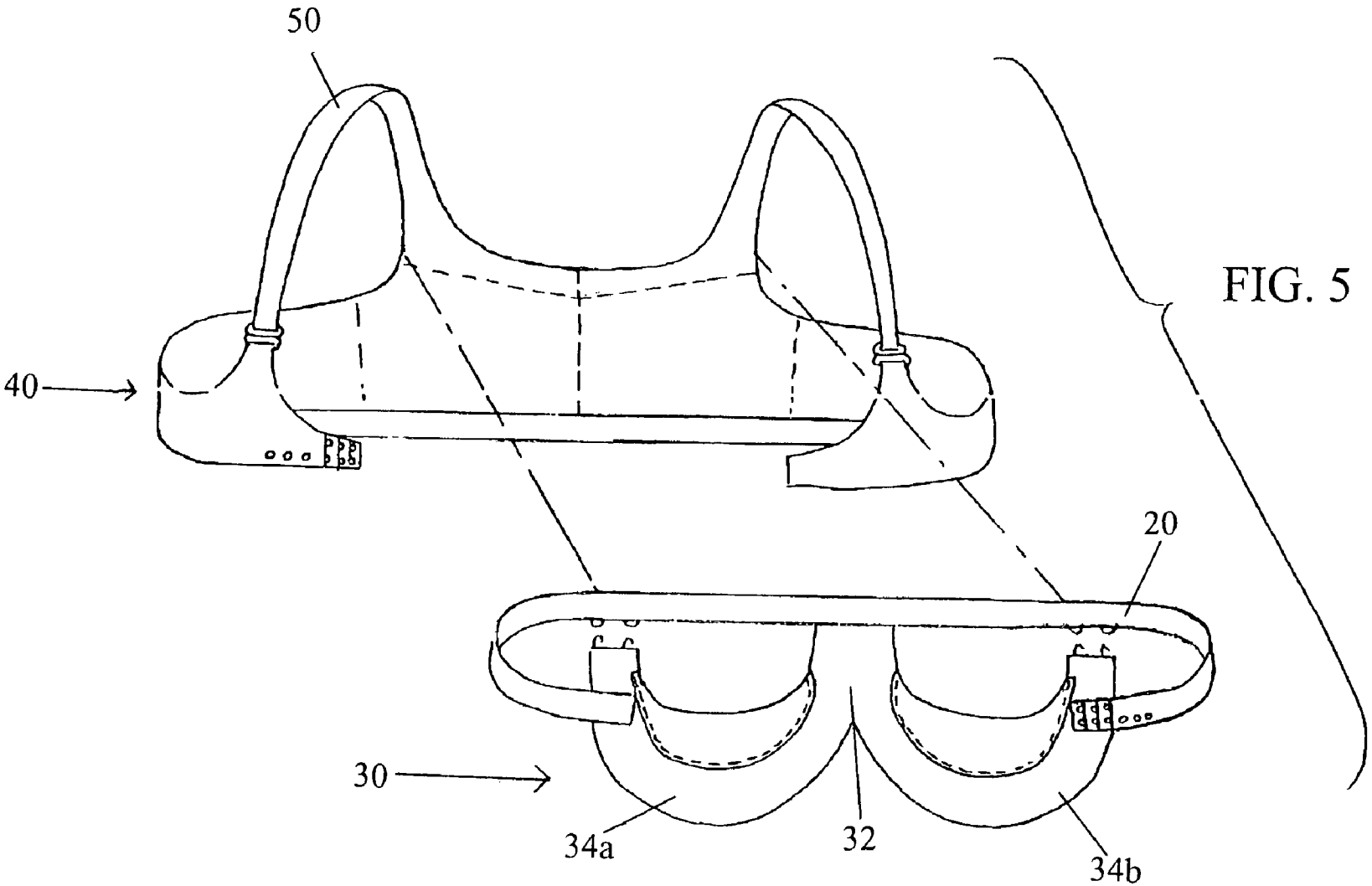
FIG. 5 is an exploded view of the support garment of the present invention.

Referring now to FIG. 5, the outer restraint bandeau 40 is a band of material that extends the full length of the support garment 10. As can be seen from the exploded view, the breast support and isolating structure is coupled to the inner surface of the outer restraint bandeau. The outer restraint bandeau 40 overlies the breast support and isolating structure 30 and includes means for fastening 42, preferably in an adjustable manner, both of its ends at or around the wearer's back. The fastening means 42 may be any adjustable fastening means known in the art such as hooks, snaps, buckles, Velcro, etc. The bandeau 40 is secured to the upper restraint band 20. The upper restraint band 20 may also be part of the upper portion of the outer restraint bandeau 40, as shown in FIG. 6. Preferably, the upper restraint band 20 forms the upper edge of the outer restraint bandeau 40, as shown in FIGS. 1-3.

Referring now to FIG. 2, the outer restraint bandeau 40 may be formed of several bands of various materials. For example, the top portion 40*a* and the bottom portion 40*c* of the bandeau 40 may be formed of an elastic material, while the middle portion 40*b* is formed of a non-elastic material. On the other hand, the entire bandeau 40 may be formed of a single band with elastic properties. It is understood that a variety of arrangements of elastic and non-elastic bands may be used to form the bandeau 40 of the present invention.

The outer restraint bandeau 40 functions to restrain the wearer's breasts in various ways. When only the top portion 40*a* of the bandeau 40 is made of an elastic material, the bandeau 40 restrains the breasts from any upward movement. It is understood that if the upper restraint band 20 is a separate structure from the bandeau 40, then the bandeau 40 may provide upper restraint in conjunction with the restraint provided by the upper restraint band 20. When the entire bandeau

40 is made of a material with elastic properties, the bandeau 40 restrains the breasts by compressing them against the wearer's body. This restraint reduces the movement of the breasts while at the same time shifts the burden of supporting the breasts to the wearer's back rather than the wearer's shoulders. This helps reduce strain on the wearer's shoulders and neck. Additionally, although the wearer's breasts are compressed, the breast support and isolating structure 30 maintains the wearer's comfort. Finally, the bottom portion 40*c* of the bandeau 40 may be made of a material with elastic properties forming a lower restraint band 24. The lower restraint band 24 prevents the bandeau 40 and the rest of the support garment 10 from riding up during intense physical activity and causing chafing. The bottom elastic portion 40*c* also assists the breast support and isolating structure 30 in supporting the breasts in a raised position.

In a preferred embodiment, a pair of conventional shoulder straps 50 are secured to either the upper restraint band 20, as in FIG. 4, or to the outer restraint bandeau 40, as shown in FIGS. 5 and 6. The shoulder straps 50 function to hold the support garment 10 in place and to bear some of the burden of supporting the weight of the wearer's breasts.

The support garment of the present invention provides a wearer with total support and restraint of the breasts. This is accomplished by restraining the breasts, in a comfortable and fully customizable manner, from various directions in order to eliminate, or at least substantially reduce, any movement of the breasts during physical activity. The present invention further provides for a support garment that restrains and supports the wearer's breasts in a manner that reduces the strain imposed on the wearer's neck and back. The present invention further provides for a support garment that restrains and supports the wearer's breasts in a manner that does not irritate the wearer's breasts or skin around the ribcage. Finally, the support garment of the present invention supports and restrains the wearer's breasts in a manner that is aesthetically pleasing.

It is understood that the invention may be embodied in various forms other than those herein specifically illustrated or described and that in the illustrated forms certain changes in the details of the construction and in the arrangement of parts may be made without departing from the principles or underlying ideas of the invention within the scope of the appended claims.

What is claimed is:

1. A breast support garment comprising:

an upper restraint band having a central portion and an inner surface and extending horizontally along a length of said breast support structure;

a breast isolating structure attached to and extending downward from the central portion of said upper restraint band;

a pair of breast support structures extending in opposite directions from the breast isolating structure and being adjustably affixed to the inner surface of said upper restraint band; and an outer restraint bandeau having a central portion and extending in a direction similar to that of said upper restraint band, wherein said outer restraint bandeau overlies said breast isolating structure and said pair of breast support structures and wherein the central portion of the upper restraint band is attached to the upper central portion of the outer restraint bandeau.

2. The breast support garment of claim 1, wherein said breast isolating structure and said pair of breast supporting structures are a unitary structure.

3. The breast support garment of claim 1, wherein said outer restraint bandeau further comprises two ends and means for adjustably attaching said ends together.

4. The breast support garment of claim 1 further comprising a pair of shoulder straps extending from said outer restraint bandeau.

5. The breast support garment of claim 1 further comprising a pair of shoulder straps extending from said upper restraint band.

6. The breast support garment of claim 1, wherein said upper restraint band further comprises two ends and means for adjustably attaching said ends together.

7. The breast support garment of claim 1, wherein an upper portion of said outer restraint bandeau comprises said upper restraint band.

8. The breast support garment of claim 1, wherein a lower portion of said outer restraint bandeau is formed of an elastic material.

9. The breast support garment of claim 1, wherein a center portion of said outer restraint bandeau is made of an elastic material.

10. The breast support garment of claim 1, wherein said upper restraint band is formed of an elastic material.

11. The breast support garment of claim 1, wherein said pair of breast support structures are formed of an elastic material.

12. The breast support garment of claim 1, wherein said outer restraint bandeau is made entirely of an elastic material.

13. The breast support garment of claim 1, wherein the breast isolating structure is connected to the center of the upper restraint band and provides vertical separation of the wearer's breasts and wherein the breast isolating structure separates into two elastic straps, which go underneath each breast, encircle and lift each breast, and hold each breast in a raised position so that movement of each breast is significantly reduced during movement of the wearer.

14. A breast support garment comprising:

an upper restraint band having a central portion and an inner surface and extending horizontally along a length of said breast support structure;

a breast isolating structure attached to and extending downward from the central portion of said upper restraint band;

a pair of breast support structures extending in opposite directions from the breast isolating structure and being adjustably affixed to the inner surface of said upper restraint band; and an outer restraint bandeau having a central portion and extending in a direction similar to that of said upper restraint band, wherein said outer restraint bandeau overlies said breast isolating structure and said pair of breast support structures, wherein the central portion of the upper restraint band is attached to the central portion of the outer restraint bandeau, and wherein said upper restraint band further comprises two ends and means for adjustably attaching said ends together.

15. A breast support garment comprising:

an upper restraint band having a central portion and an inner surface and extending horizontally along a length of said breast support structure;

a breast isolating structure attached to and extending downward from the central portion of said upper restraint band;

a pair of breast support structures extending in opposite directions from the breast isolating structure and being adjustably affixed to the inner surface of said upper restraint band; and an outer restraint bandeau attached to the upper restraint band, the outer restraint bandeau extending in a direction similar to that of said upper restraint band and overlying said breast isolating structure and said pair of breast support structures, wherein said breast isolating structure and said pair of breast supporting structures are a unitary structure, wherein the breast isolating structure is connected to the center portion of the upper restraint band and provides vertical separation of the wearer's breasts, and wherein the breast isolating structure separates into two elastic straps, which go underneath each breast, encircle and lift each breast, and hold each breast in a raised position so that movement of each breast is significantly reduced during movement of the wearer.

16. The breast support garment of claim 15, wherein the upper restraint band circles a wearer's body and has a separate closure mechanism in back.

* * * * *